US005129632A

United States Patent [19]

Uzu et al.

[11] Patent Number: 5,129,632

[45] Date of Patent: Jul. 14, 1992

[54] HEAT TREATMENT APPARATUS FOR THIN SPHEROIDAL GRAPHITE CAST IRON PRODUCTS

[75] Inventors: Yasuhiro Uzu; Hideaki Nagayoshi, both of Kitakyusyu; Ryuzaburo Ishizaka, Saitama, all of Japan

[73] Assignee: Hitachi Metals, Ltd., Tokyo, Japan

[21] Appl. No.: 718,902

[22] Filed: Jun. 24, 1991

Related U.S. Application Data

[63] Continuation of Ser. No. 482,044, Feb. 20, 1990, abandoned.

[30] Foreign Application Priority Data

Feb. 20, 1989 [JP] Japan ..... 1-40074

[51] Int. Cl.[5] ..... C21D 1/62

[52] U.S. Cl. ..... 266/259; 266/249

[58] Field of Search ..... 266/249, 252, 259; 164/269, 270.1; 148/3, 321

[56] References Cited

U.S. PATENT DOCUMENTS 2,976,586 3/1961 Griggs ..... 164/269

4,280,301 7/1981 Herzog et al. ..... 164/269

*Primary Examiner*—S. Kastler

*Attorney, Agent, or Firm*—Finnegan, Henderson, Farabow, Garrett & Dunner

[57] ABSTRACT

A heat treatment apparatus for thin spheroidal graphite cast iron products comprising a cast iron product remover for removing a thin spheroidal graphite cast iron product from a casting mold; a continuous furnace having an inlet positioned near the cast iron product remover, the continuous furnace comprising a uniform temperature zone kept at a temperature equal to or higher than an $A_3$ transformation point of the thin spheroidal graphite cast iron product and a cooling zone downstream of the uniform temperature zone; a first conveying means for the thin cast iron product disposed between the cast iron product remover and the inlet of the continuous furnace; and a second conveying means for the thin cast iron product moving through the continuous furnace, the thin cast iron product being conveyed to the second conveying means by means of the first conveying means immediately after removed from the casting mold and introduced into the continuous furnace by means of the second conveying means.

5 Claims, 5 Drawing Sheets

HEAT TREATMENT APPARATUS FOR THIN SPHEROIDAL GRAPHITE CAST IRON PRODUCTS

This application is a continuation of application Ser. No. 07/482,044, filed Feb. 20, 1990 now abandoned.

BACKGROUND OF THE INVENTION

The present invention relates to a heat treatment apparatus for thin spheroidal graphite cast iron products.

Recently, attempts have been made to produce thin cast iron products for the purpose of improving mechanical strength. However, since melts of spheroidal graphite cast iron are quickly cooled in casting molds in the case of thin cast iron products, cementite phases are likely to appear. The thin cast iron products of spheroidal graphite cast iron in which cementite phases are precipitated are poor in cuttability, elongation and impact strength. Accordingly, they are easily broken. To overcome these problems, thin cast iron cooled to low temperatures such as room temperature, are heated again to temperatures equal to or higher than their $A_3$ transformation points, for instance, 850°-950° C. By this heat treatment, cementite is decomposed and pearlite in the matrix is ferritized.

However, when this heat treatment is conducted on thin spheroidal graphite cast iron products, primarily precipitated spheroidal graphite particles (hereinafter referred to as "primary spheroidal graphite particles") are diffused in the matrices, leaving fine gaps around their graphite particles. As a result, the thin spheroidal graphite cast iron products inevitably have reduced mechanical properties, particularly fatigue strength.

In addition, since the spheroidal graphite cast iron products are heated to a high temperature after cooled to room temperature, a large amount of thermal energy is consumed, meaning that this process is economically disadvantageous.

As a method for solving these problems, the applicants previously filed a patent application in Japan for a method of producing a thin high-strength article of spheroidal graphite cast iron having spheroidal graphite particles dispersed in a ferrite matrix containing 10% or less of pearlite with substantially no fine gaps between the spheroidal 10 graphite particles and the ferrite matrix, by pouring a melt having a spheroidal graphite cast iron composition into a casting mold; removing the casting mold by shake-out after the completion of solidification of the melt, while substantially the entire portion of the resulting cast iron product is still at a temperature of its $A_3$ transformation point or higher; immediately introducing the cast iron product into a uniform temperature zone of a continuous furnace kept at a temperature of the $A_3$ transformation point or higher, where the cast iron product is held for 30 minutes or less to decompose cementite contained in the matrix; and transferring the cast iron product into a cooling zone of the continuous furnace to cool the cast iron product at such a cooling speed as to achieve the ferritization of the matrix. (Japanese Patent Application No. 1-234485 claiming domestic priority of Sept. 9, 1988, corresponding to U.S. Ser. No. 403,876).

Thus, an apparatus for efficiently conducting the above method has been desired.

OBJECT AND SUMMARY OF THE INVENTION

Accordingly, an object of the present invention is to provide a heat treatment apparatus for efficiently producing thin cast iron products of spheroidal graphite cast iron having good mechanical properties, particularly improved fatigue strength.

In view of the above object, the inventors of the present invention have found that by heat-treating a thin cast article of spheroidal graphite cast iron, without cooling it to room temperature after removal from a casting mold, at a temperature of its $A_3$ transformation point or higher for a short period of time and cooling it at a controlled cooling speed, the diffusion of spheroidal graphite particles into the surrounding ferrite matrix of the spheroidal graphite cast iron can be effectively prevented while achieving the ferritization of the matrix, whereby spheroidal graphite cast iron products substantially free from fine gaps around the spheroidal graphite particles in the matrix can be obtained, and that such spheroidal graphite cast iron products have extremely improved mechanical properties, particularly fatigue strength. The present invention is based upon this finding.

Thus, the heat treatment apparatus for thin spheroidal graphite cast iron products comprises a cast iron product remover for removing a thin spheroidal graphite cast iron product from a casting mold; a continuous furnace having an inlet positioned near the cast iron product remover, the at temperature equal to or higher than an $A_3$ transformation point of the thin spheroidal graphite cast iron product and a cooling zone downstream of the uniform temperature zone; a first conveying means for the thin cast iron product disposed between the cast iron product remover and the inlet of the continuous furnace; and a second conveying means for the thin cast iron product moving through the continuous furnace, the thin cast iron product being conveyed to the second conveying means by means of the first conveying means immediately after removed from the casting mold and introduced into the continuous furnace by means of the second conveying means.

DETAILED DESCRIPTION OF THE INVENTION

Figure 1:
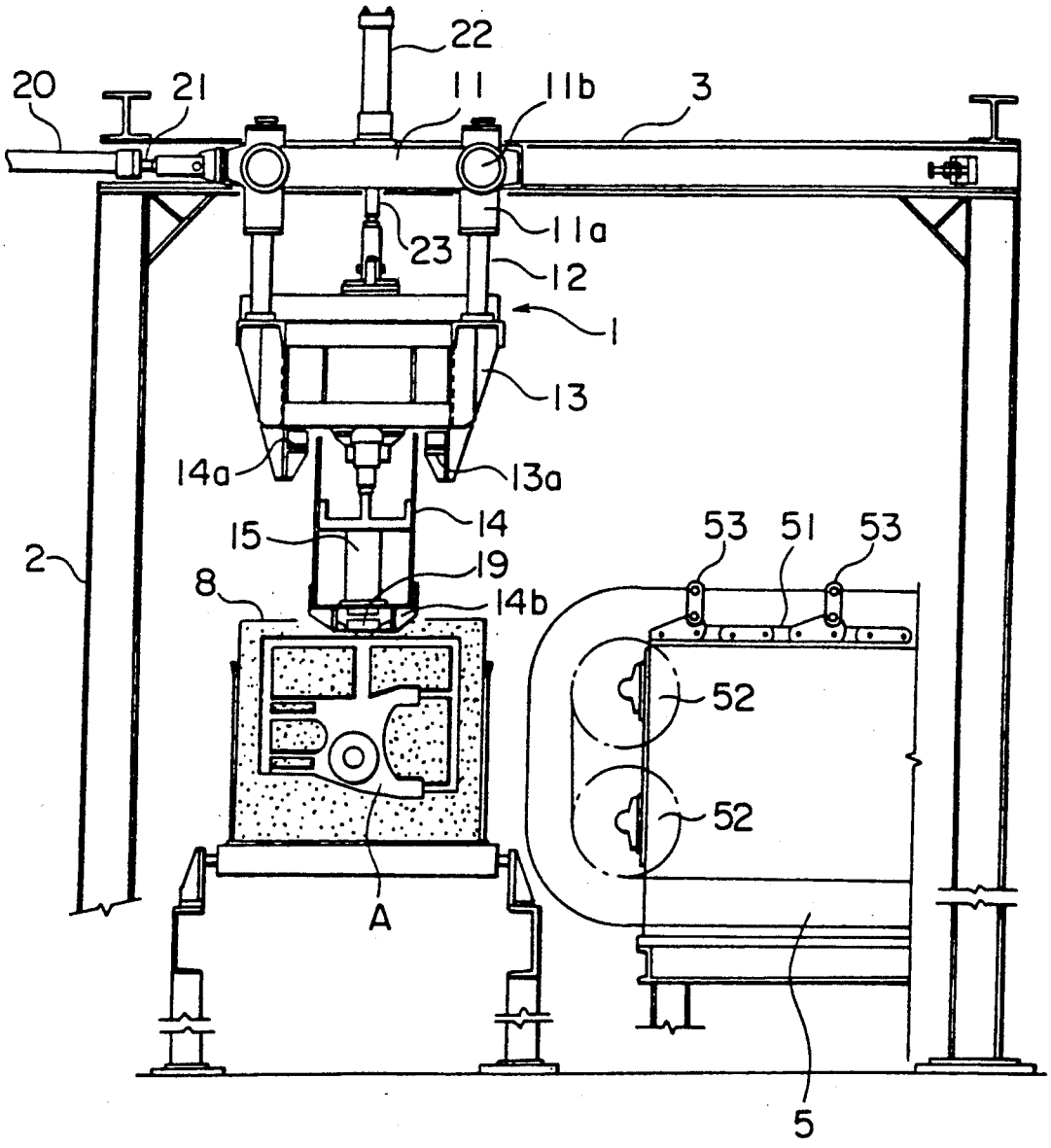
FIG. 1 is a front view showing a cast iron product in the heat treatment apparatus according to one embodiment of the present invention.

Referring to FIGS. 1-4, the heat treatment apparatus of the present invention comprises a cast iron product remover 1, a first conveying means 5, a second conveying means 6 and a continuous furnace 7.

The cast iron product remover 1 comprises an upper support member 11 movable along beams 3 supported by a plurality of vertical supports 2, a lower support member 13 hanging from the upper support member 11 via rods 12 vertically movable through cylinders 11*a* of the upper support member 11, and a movable member 14 horizontally movable along the lower support member 13.

As shown in FIG. 1, the upper support member 11 has rollers 11*b* at corners thereof, which make the upper support member 11 horizontally movable along the beams 3. A rod 21 of a first horizontal cylinder 20 is connected to one end of the upper support member 11, so that the upper support member 11 can move transversely to the moving direction of casting molds.

The lower support member 13, which is connected to the upper support member 11 via the rods 12 vertically movable through the cylinders 11*a*, is located at a vertical position set by a vertical cylinder 22. The vertical cylinder 22 is fixed to the upper support member 11, and a lower end of a rod 23 of the vertical cylinder 22 is connected to an upper end of the lower support member 13.

The lower support member 13 has a pair of guide rails 13*a*, on which the movable member 14 having a plurality of rollers 14*a* is movably supported. A rod 25 of a second horizontal cylinder 24 is connected to a rear end of the movable member 14, and the second horizontal cylinder 24 is fixed to the lower support member 13.

The movable member 14 is provided at its lower end with a means 14*b* engageable with a part (sprue) 19 of the thin cast iron product A for removing it from the casting mold. The means 14*b* may have a C-shaped cross section whose opening is directed downward so that a part (sprue) of the thin cast iron product A can engage a pair of inwardly projecting portions of the C-shaped means 14*b*. However, it should be noted that the cast iron product-engaging means 14*b* may have any cross section as long as it is engageable with a part of the thin cast iron product A.

Figure 3:
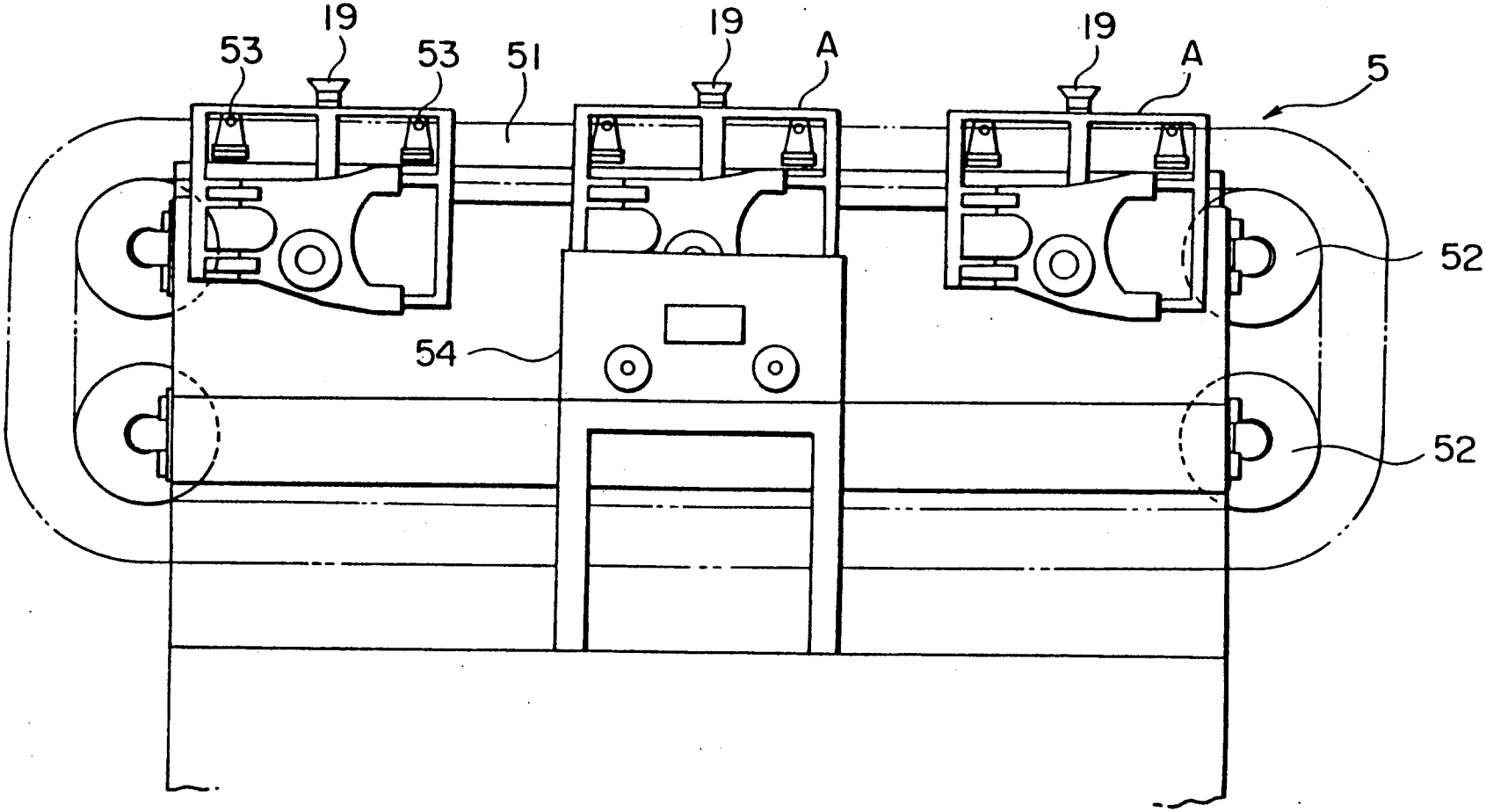
FIG. 3 is a front view showing a first conveying means for thin cast iron products in the heat treatment apparatus.

The first conveying means 5 comprises an endless chain 51 intermittently moved by a driving means (not shown), and a plurality of pulleys 52 for defining the path of the endless chain 51. The endless chain 51 is provided with plural pairs of pins 53 at appropriate intervals for hanging the thin cast iron products A. As shown in FIG. 3, the first conveying means 5 may have a sand-removing vibrator 54.

Figure 4:
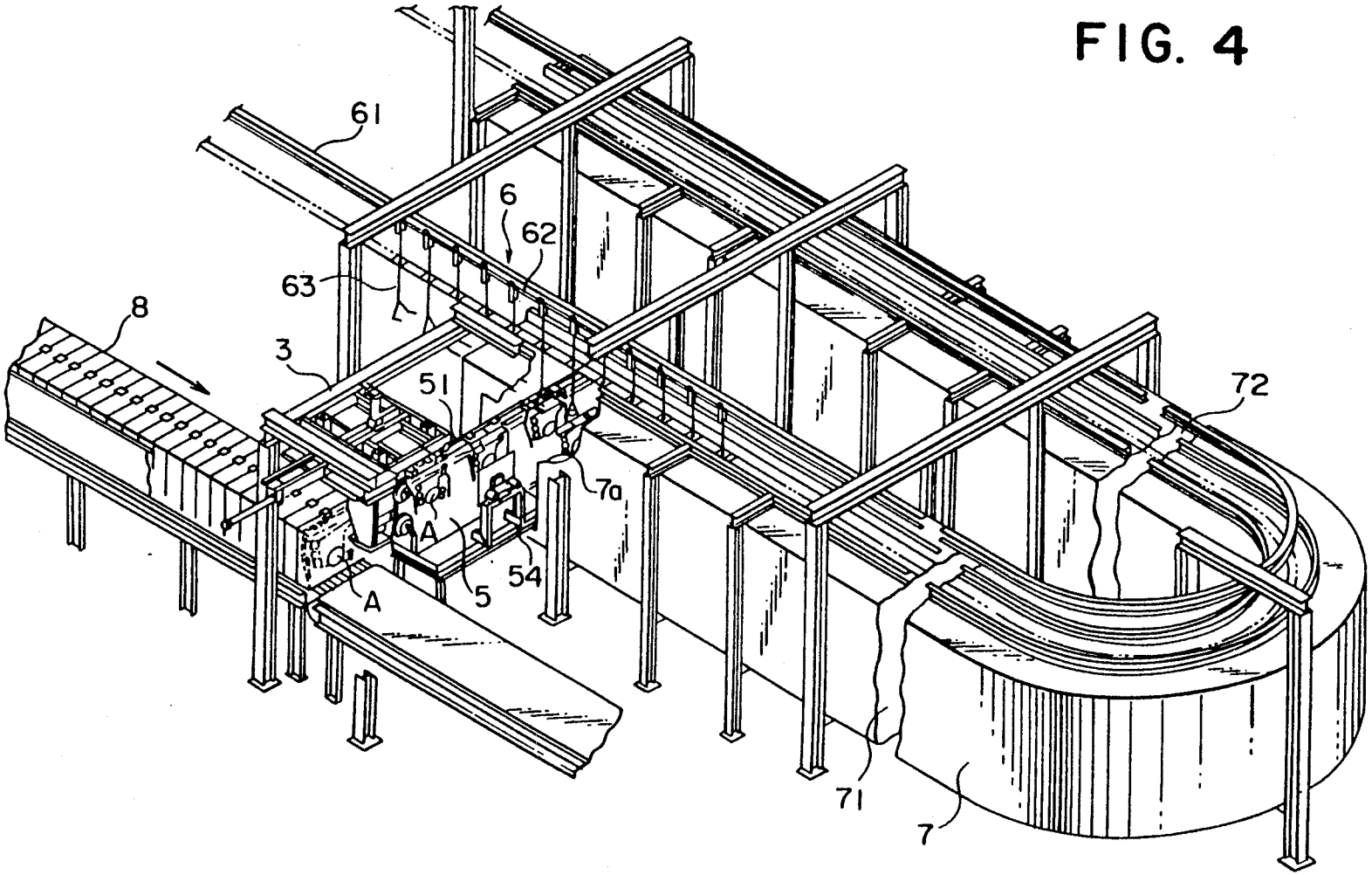
FIG. 4 is a perspective view showing the heat treatment apparatus.

As shown in FIG. 4, a second conveying means 6 extending in a direction perpendicular to that of the endless chain 51 comprises a guide 61 perpendicular to the endless chain 51, a conveyor chain 62 movable along the guide 61, and a plurality of trolley hangers 63 attached to the conveyor chain 62 at constant intervals. The guide 61 may be linear, but to reduce a space for the guide 61, it is preferably bent in one or more portions.

The continuous furnace 7 is disposed along the guide 61. An inlet 7*a* of the continuous furnace 7 should be located as close to the endless chain 51 as possible, to minimize the cooling of the thin cast iron products A. The continuous furnace 7 is constituted by a uniform temperature zone 71 and a cooling zone 72.

Figure 5:
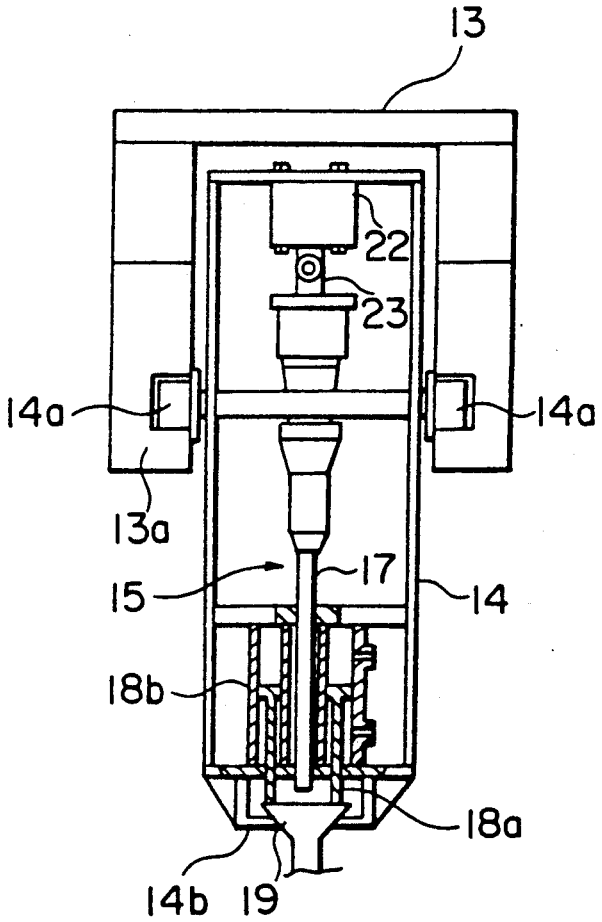
FIG. 5 is a partially cross-sectional front view showing a cast iron product remover provided with a sand removing means.

FIG. 5 shows another example of the movable member 14 provided with a cast iron product remover 15. In this embodiment, the cast iron product remover 15 comprises a pneumatic hammer 17 connected to a lower end of the rod 23 of the vertical cylinder 22, an inner hollow cylindrical member 18*a* arranged around the pneumatic hammer 17, and an outer hollow cylindrical member 18*b* arranged around the inner hollow cylindrical member 18*a* for supporting it.

Figure 2:
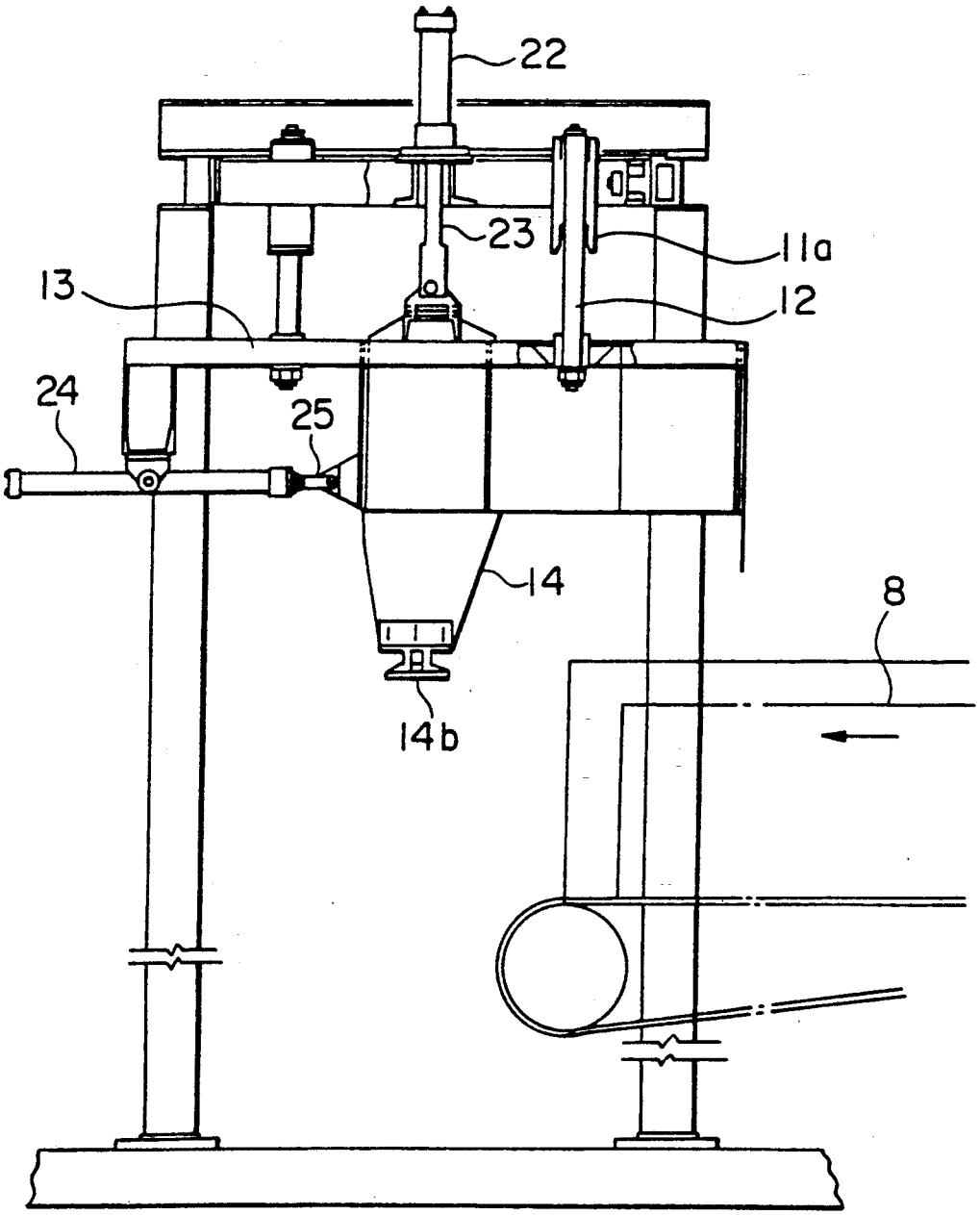
FIG. 2 is a side view showing the cast iron product remover of FIG. 1.

Next, the heat treatment apparatus having the above structure is operated as follows:

First, a melt of the spheroidal graphite cast iron is poured into vertical type, frameless casting molds 8 formed by a continuous mold forming line (not shown), and the casting molds 8 are moved in the direction shown by the arrow (see FIGS. 2 and 4).

When each casting mold 8 reaches a mold removing (shake-out) position, the rod 23 of the vertical cylinder 22 of the cast iron product remover 1 moves downward. When the cast iron product-engaging means 14*b* reaches the same height as that of a sprue 19 of the thin cast iron product A, the rod 25 of the second horizontal cylinder 24 projects forward, whereby the means 14*b* engages the sprue 19 of the thin cast iron product A.

When the means 14*b* engages the sprue 19, the outer hollow cylindrical member 18*b* is operated to cause the inner hollow cylindrical member 18*a* to move downward, thereby fixing the sprue 19 of the thin cast iron product A. Compressed air is then supplied to the pneumatic hammer 17 so that a tip end of the pneumatic hammer 17 vibrates the sprue 19 to remove mold sands from the thin cast iron product A.

Next, after the rod 23 of the vertical cylinder 22 is elevated, the rod 21 of the first horizontal cylinder 20 projects so that the thin cast iron product A is transferred to a pair of pins 53 of the endless chain 51.

The driving means of the first conveying means 5 is operated to move the endless chain 51. The endless chain 51 stops at a position where the thin cast iron product A is placed on a sand-removing vibrator 54. The mold sands remaining on the thin cast iron product A are removed by this sand-removing vibrator 54.

Next, the endless chain 51 is moved again to convey the thin cast iron product A to a position at which the thin cast iron product A engages the trolley hanger 63 movable through the continuous furnace 7. Since the trolley hanger 63 is moving continuously, the thin cast iron product A hanging from the trolley hanger 63 continuously moves through the continuous furnace 7.

Incidentally, the casting mold 8 moves intermittently at an interval of about 15 seconds, and the thin cast iron product A removed from the casting mold 8 is quickly transferred to the trolley hanger 63 of the continuous furnace 7 to prevent the thin cast iron product A from being cooled to a temperature lower than the $A_3$ transformation point.

The thin cast iron product A is subjected to a heat treatment while passing through the uniform temperature zone 71 and the cooling zone 72.

In the heat treatment process using the apparatus of the present invention, the thin cast iron product A having a spheroidal graphite cast iron composition is removed from the casting mold 8 while it is still at a temperature equal to or higher than the $A_3$ transformation point (about 850° C.), introduced into the uniform temperature zone 71 of the continuous furnace 7 kept at a temperature between the $A_3$ transformation point and the melting point of the thin spheroidal graphite cast iron product, kept there for a short period of time, and then cooled in the cooling zone 72 at a controlled cooling speed.

Incidentally, the thin cast iron product A removed from the casting mold can be quickly introduced into the continuous furnace 7 by means of the first conveying means 5 preferably within about 40 seconds.

In the continuous furnace 7, the cast iron product is held in a uniform temperature zone 71 kept at a temperature of the $A_3$ transformation point or higher for 30 minutes or less, preferably 1–25 minutes, and more preferably 5–20 minutes. The temperature of the uniform temperature zone 71 of the continuous furnace 7 is preferably 850–950° C.

When the time of keeping the cast iron product A in the uniform temperature zone 71 of the continuous furnace 7 exceeds 30 minutes, the cast iron product A has increased strain, and such a long keeping time is economically disadvantageous.

After removal from the casting mold, the thin cast iron product A is immediately subjected to the heat treatment, to prevent the rapid cooling of the thin cast iron product A thereby avoiding the formation of cementite phases.

It is a surprising discovery that substantially all cementite can be decomposed or removed by a heat treatment at a temperature of the $A_3$ transformation point or higher for such a short period of time as 30 minutes or less, if this heat treatment is conducted immediately after removal from the casting mold while the cast iron product is still in a state that the $A_3$ transformation has not occurred in the matrix yet. On the other hand, if the heat treatment is conducted after once cooled to a lower temperature such as room temperature, the decomposition of a cementite phase requires much more time, usually nearly 2 or 3 hours. The reason why the decomposition of cementite can be achieved in such a short period of time in the heat treatment of the present invention is not necessarily clear, but it may be presumed that the cementite phase is not formed in a large amount when the thin cast iron product is not cooled to a low temperature. In general, since the thin cast iron product tends to be cooled rapidly, a large amount of cementite is likely to be formed in the cooling process. Accordingly, by conducting the heat treatment immediately after removal from the mold, the formation of a large amount of cementite can be prevented.

The cast iron product is then transferred from the uniform temperature zone 71 to the cooling zone 72 in the continuous furnace 7, and cooled in the cooling zone 72 at a cooling speed of 40° C./min or less, preferably 5°–25° C./min. When the cooling speed exceeds 40° C./min, pearlite tends to remain in the resulting matrix, thereby hardening the spheroidal graphite cast iron and reducing its toughness and cuttability.

It is then taken out from the continuous furnace 7 at a temperature of its $Ar_1$ transformation point (about 700° C.) or lower, specifically 650° C. or lower.

The cast iron product thus produced has graphite particles having an average particle size of 20 μm or less and a maximum particle size of 60 μm or less. When the average particle size of the graphite particles exceeds 20 μm, the thin cast iron product has low fatigue strength. The preferred average particle size of the graphite particles is 15 μm or less. The cast iron product also has a ferrite matrix containing a reduced amount of pearlite. The pearlite content in the matrix expressed by ratio in area is as small as 10% or less, particularly 5% or less.

Incidentally, the spheroidal graphite cast iron having such structure generally has a composition consisting essentially of 3.50–3.90 weight % of C, 2.0–3.0 weight % of Si, 0.35 weight % or less of Mn, 0.10 weight % or less of P, 0.02 weight % or less of S, 0.025–0.06 weight % of Mg and balance substantially Fe and inevitable impurities.

The means "thin spheroidal graphite cast iron product" used herein means a spheroidal graphite cast iron product whose substantial portion is as thin as 12 mm or less, preferably 8 mm or less, particularly 2–5 mm. The thin cast iron products may have thick ribs partially.

When the spheroidal graphite cast iron product is as thin as 12 mm or less, it is likely to be rapidly cooled, thereby forming a large amount of cementite in the matrix. When the rapidly cooled spheroidal graphite cast iron product is heated again to 850°–950° C., primary deposited graphite particles tend to be diffused into the surrounding ferrite matrix, resulting in the generation of fine gaps between the graphite particles and the ferrite matrix. Thus, the conventional spheroidal graphite cast iron has relatively poor mechanical properties, when they are thin. This problem has been solved by the present invention. That is, a heat treatment using the apparatus of the present invention prevents fine gaps from being generated between the graphite particles and the ferrite matrix, because the spheroidal graphite cast iron is heat-treated at a temperature of the $A_3$ transformation point or higher in a short period of time of 30 minutes or less immediately after solidification. Incidentally, 2 mm is a lower limit in thickness in practical applications.

The thin spheroidal graphite cast iron products produced by the heat treatment apparatus according to the present invention are suitable for castings such as suspension parts for automobiles, etc., which have thin portions and require large strength and toughness.

The present invention will be described in further detail by the following Example.

EXAMPLE 1

(1) Composition

A cast iron material having a composition consisting essentially of iron, inevitable impurities and the following components was used to produce a test piece having a thickness of 3 mm.

C: 3.66 weight %
Si: 2.14 weight %
Mn: 0.26 weight %
P: 0.024 weight %
S: 0.009 weight %
Mg: 0.036 weight % (2) Heat treatment A spheroidal graphite cast iron melt having the above composition was poured into a mold at 1420° C., and after 5 minutes the resulting test piece was taken out. It was immediately introduced into a uniform temperature zone of a continuous furnace kept at 850° C. and held therein for 10 minutes. After that, it was transferred into a cooling zone, where it was cooled to 650° C. over 20 minutes and then discharged from the continuous furnace.

The test piece subjected to the above heat treatment was a thin spheroidal graphite cast iron product completely composed of a ferrite matrix and having a Brinell hardness of as high as 156 (JIS G 5502, FCD 37).

As described above in detail, unlike the conventional apparatuses in which the thin cast iron products once cooled are reheated for a heat treatment, the heat treatment apparatus for the thin spheroidal graphite cast iron products according to the present invention has a structure in which the thin cast iron products are removed from casting molds as soon as melts poured into the casting molds are solidified and introduced into the continuous furnace by means of the first conveying means. Accordingly, the resulting thin cast iron products are substantially free from fine gaps around the spheroidal graphite particles, showing good mechanical properties.

In addition, the heat treatment apparatus of the present invention can decrease energy consumption significantly and does not need a cooling line which is conventionally disposed downstream of the shake-out means.

Incidentally, when the movable member is provided with the sand removing means, sand removal can be conducted simultaneously with the removal of the thin cast iron product from the casting mold, making the entire process more efficient. In addition, the sand-removing vibrator disposed in the first conveying means serves to complete sand removal.

What is claimed is:

1. A heat treatment apparatus for heat treating thin spheroidal graphite cast iron products cast in casting molds, the apparatus comprising a cast iron product remover for removing the thin spheroidal graphite cast iron products from the casting molds; a continuous furnace having an inlet positioned near said cast iron product remover, said continuous furnace comprising a uniform temperature zone kept at a temperature equal to or higher than an $A_3$ transformation point of said thin spheroidal graphite cast iron products and a cooling zone downstream of said uniform temperature zone; a first conveying means for said thin cast iron products disposed between said cast iron product remover and the inlet of said continuous furnace; and a second conveying means for said thin cast iron products moving through said continuous furnace, said thin cast iron products being conveyed to said second conveying means by means of said first conveying means immediately after removal from said casting mold and being introduced into said continuous furnace by means of said second conveying means.

2. The heat treatment apparatus for thin spheroidal graphite cast iron products according to claim 1, further comprising a sand removing means.

3. The heat treatment apparatus for thin spheroidal graphite cast iron products according to claim 1, wherein said second conveying means is a means for hanging said thin cast iron products being conveyed through said continuous furnace.

4. The heat treatment apparatus for thin spheroidal graphite cast iron products according to claim 1, wherein said first conveying means comprises an endless chain movable between said cast iron product remover and said second conveying means, said endless chain being provided with plural pairs of pins for hanging said thin cast iron products.

5. The heat treatment apparatus for thin spheroidal graphite cast iron products according to claim 1, wherein said cast iron product remover comprises a movable member provided with a means engageable with a part of each of said thin cast iron products for removing said thin cast iron products from said casting mold, said movable member being further provided with a sand-removing means for removing mold sand from the thin cast iron products.

* * * * *